US006955374B2

(12) United States Patent
Stefanova et al.

(10) Patent No.: US 6,955,374 B2
(45) Date of Patent: Oct. 18, 2005

(54) SNOW BOARD

(75) Inventors: Milena Stefanova, Saint-Barthelemy de Cechilienne (FR); Eric Restani, Voiron (FR)

(73) Assignee: Skis Rossignol, SA, Voiron (FR)

( * ) Notice: Subject to any disclaimer, the term of this patent is extended or adjusted under 35 U.S.C. 154(b) by 0 days.

(21) Appl. No.: 10/306,676

(22) Filed: Nov. 26, 2002

(65) Prior Publication Data

US 2003/0146599 A1 Aug. 7, 2003

(30) Foreign Application Priority Data

Nov. 27, 2001 (FR) ..... 01 15287

(51) Int. Cl.[7] ..... A63C 5/04
(52) U.S. Cl. ..... 280/602; 280/607; 280/617
(58) Field of Search ..... 280/601, 602, 280/607, 608, 11.14, 11.15, 611, 613, 623, 617, 609, 618, 14.22

(56) References Cited

U.S. PATENT DOCUMENTS

| | | | | | |
|---|---|---|---|---|---|
| 4,408,779 | A | | 10/1983 | Shekter | 280/607 |
| 4,697,820 | A | * | 10/1987 | Hayashi et al. | 280/609 |
| 4,848,784 | A | * | 7/1989 | Scherubl | 280/602 |
| 5,232,241 | A | | 8/1993 | Knott et al. | 280/607 |
| 5,249,819 | A | * | 10/1993 | Mayr | 280/602 |
| 5,299,822 | A | * | 4/1994 | Mayr et al. | 280/610 |
| 5,427,401 | A | * | 6/1995 | Liard | 280/609 |
| 5,435,588 | A | * | 7/1995 | Commier et al. | 280/602 |
| 5,447,322 | A | * | 9/1995 | le Masson et al. | 280/602 |
| 5,474,321 | A | * | 12/1995 | Pritz | 280/607 |
| 5,580,077 | A | * | 12/1996 | Dodge | 280/607 |
| 5,671,940 | A | | 9/1997 | Abondance | 280/602 |
| 5,785,342 | A | | 7/1998 | Bronson | 280/602 |
| 5,871,223 | A | * | 2/1999 | Zanco | 280/607 |
| 6,131,939 | A | * | 10/2000 | Fels | 280/601 |

* cited by examiner

*Primary Examiner*—Bryan Fischmann
*Assistant Examiner*—Brian Swenson
(74) *Attorney, Agent, or Firm*—Fay, Sharpe, Fagan, Minnich & McKee, LLP

(57) ABSTRACT

A ski construction such as a ski, monoski, or snow board includes a principal base support (2) which has a sliding sole (6) that is raised to form a tip (8) at its front end. An upper surface of the ski defines a housing or pocket (20) with a central contracted region defined by lateral projections (18*a*, 18*b*). One of a family of elongated complementary elements (3) with hollow profiles (12*a*, 12*b*) is frictionally received in the pocket. The complementary elements can have different lengths, thicknesses, stiffness, constructions, or material properties. By selecting among the family of complementary elements, a common principal support base can be configured to have a variety of skiing characteristics which complement the skiing abilities of a variety of skiers, skiing conditions, and the like.

20 Claims, 16 Drawing Sheets

P
8
A
A
L2
10
19'a
19'b
13
B
B
9a
9b
17
4
L1
15
18b
16
12a
12b
18a
C
T1
T2
14
11
D
D
19'b
19"b
3
2
E
E
1

SNOW BOARD

BACKGROUND OF THE INVENTION

The present invention relates to a snow sliding equipment such as a ski, monoski, snow board, or the like. It concerns more particularly an improvement relative to a sliding board comprising a support base and a complementary element intended for receiving the retention binding of the user's boot.

Over the past few years, the practice of sliding as a sports activity has become more and more adapted and developed with the practitioners of said sport making every increasing demands with respect to product quality. This is the case, for example, with respect to the sport of sliding on snow.

Numerous models of snow sliding boards are already known, and specifically ski models which comprise a beam of elongated shape, whose front extremity is raised to form the spatula, while the lower surface comprises a sliding sole bordered by metal edges.

In spite of efforts developed by the equipment builders to satisfy their clientele, to this day, there does not exist a ski which fully combines user comfort and satisfactory performance on the ski slopes, regardless of type of terrain, and regardless of type of user. Certain tentative endeavors have been made, such as for example the constructions disclosed in French Patents 2 670 392 and 2 675 391. However in order to satisfy the diversity imposed by the market, each equipment builder proposes a sizeable number of models, each of which presents its own characteristics. This requires the manufacturer to handle a significant number of models, which reduces production series and adds significantly to the fabrication costs. Applicant, with its ski disclosed by French Patent No. 2 726 193 has already proposed a ski construction according to which a body is provided on which a foot plate is fixed, and different foot plates can correspond to one body. However, in spite of enormous progress afforded by said constructions, there exists the realization that improvements are still possible.

SUMMARY OF THE INVENTION

The present invention proposes multi-use skis, formed by a support base and a complementary element, the combined shapes of which give the whole ski its required characteristics, as well as comfort in handling the ski. In addition, the structure of the ski according to the invention permits limiting the number of stiffnesses for the same model.

Thus, the sliding board according to the invention is of the type which comprises a principal part, which is called body or support base, on the upper surface of which is fixed, at least in the zone of the sole-plate, a complementary longitudinal element intended to receive the retention binding or bindings of the boot of the user, said support base having the shape of an elongated beam comprising a sliding sole, whose front extremity is raised in order to form a spatula, and is characterized in that the complementary longitudinal element is in the shape of an elongated plate, whose width, measured between its lateral edges is smaller than the width of the support base and at least one of its lateral edges comprises a hollow profile, in a manner so that the complementary element would include a front part connected to a rear part by a smaller size zone and in that the lateral retention of the complementary element is realized, at least in part, by embedment of the complementary element within a housing realized in the support base, which comprises at least one lateral retention edge comprising an internal lateral projection intended to cooperate with the hollow profile of the complementary element.

According to an additional characteristic, the length of the complementary element ranges between 30% and 60% of the length of the support base.

According to another characteristic, the housing realized in the support base is a built-in housing, limited laterally by two lateral retention edges, projecting laterally relative to the surface of the bottom of the housing and whose central zone includes for each of the edges an internal lateral projection extending towards the median plane.

In a preferred embodiment of the invention, the smaller size zone of the complementary element is approximately located in the central zone of the complementary element and each of the lateral edges comprises a hollow profile; thus, the left lateral edge comprises a left hollow profile, while the right lateral edge comprises a right hollow profile.

It should be added, according to said preferred embodiment, that the hollow profiles have a round profile, while the corresponding projections have a complementary round shape so that each of the projections form one retention projection, making sure of lateral and longitudinal retention of the complementary element relative to the support base.

According to an alternate embodiment, the complementary element is formed by two adjacent individual and independent complementary elements, each of the individual elements comprising its own hollow profile on its external lateral edge, which is supported laterally on the corresponding edge of the support base, while the internal lateral projections of the edge cooperate with the corresponding hollow profile.

It should be noted that a set of several different complementary elements can correspond to a given support base, said elements can either be of different lengths, different thickness, or have different mechanical characteristics intended to confer to the ski formed by the support base and its complementary element, different performance characteristics.

It should also be added that several complementary elements of different lengths and different shapes can correspond to a given support base, notably at the level of their front and rear extremities.

According to another alternate embodiment, several complementary elements correspond to a given support base, with at least one of said complementary elements including at least one disengagement from the extremity in the front and/or in the rear and in that the housing and notably its bottom surface is designed to cooperate with one or the other of the complementary elements, whose front and/or rear extremity comprise at least one zone in stepped-up form in such manner so as to correspond to the disengagement of the extremity or extremities of the complementary element.

According to another alternate embodiment, the complementary element is formed by two adjacent individual complementary elements, while it may be provided that these latter may be separated by a longitudinal space, which includes an intermediate element having shock-absorbing properties. Said element is, for example, of elastically deformable material such as of caoutchouc, of rubbery elastomer, of visco-elastic cacutchouc or of any equivalent material.

According to other variations, an intermediate element is provided which possesses shock-absorbing properties, and which is located between the complementary element and the lateral retention edge or edges.

Still further advantages of the present invention will become apparent to those of ordinary skill in the art upon reading and understanding the following detailed description of the preferred embodiments.

BRIEF DESCRIPTION OF THE DRAWINGS

Other characteristics and benefits of the invention are apparent from the description below in comparison with the attached drawings, which are provided by way of example only, and are not limited to same.

FIGS. 1 to 9 represent a first embodiment of the invention.

FIG. 1 is a lateral or side view of the ski whose complementary element is not positioned on the support base.

FIG. 2 is a lateral view of the ski with the complementary element put in place on the support base.

FIG. 3 is a bird's eye or top view of the complementary element only.

FIG. 4 is a bird's eye view of the support base only, without the complementary element.

FIG. 5 is a bird's eye view of the ski whose support base is equipped with its complementary element.

FIG. 8 is an expanded perspective view of the ski, prior to placement of the complementary element on the support base.

FIG. 9 is a perspective view of the ski with the support base equipped with its complementary element.

DETAILED DESCRIPTION OF PREFERRED EMBODIMENTS

Figure 1:
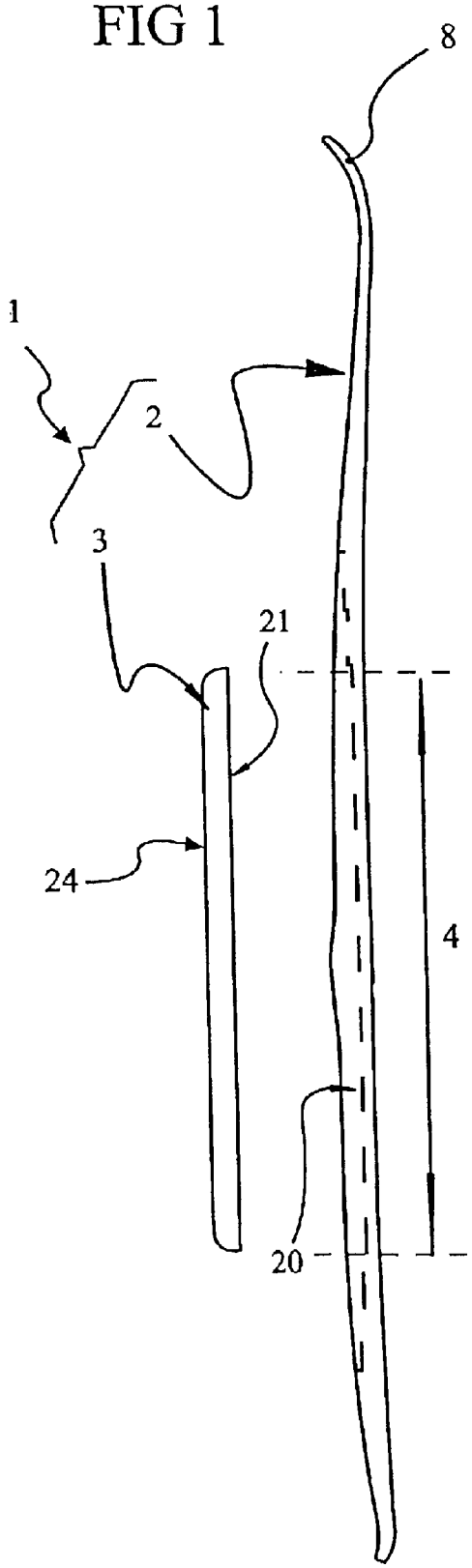
Figure 2:
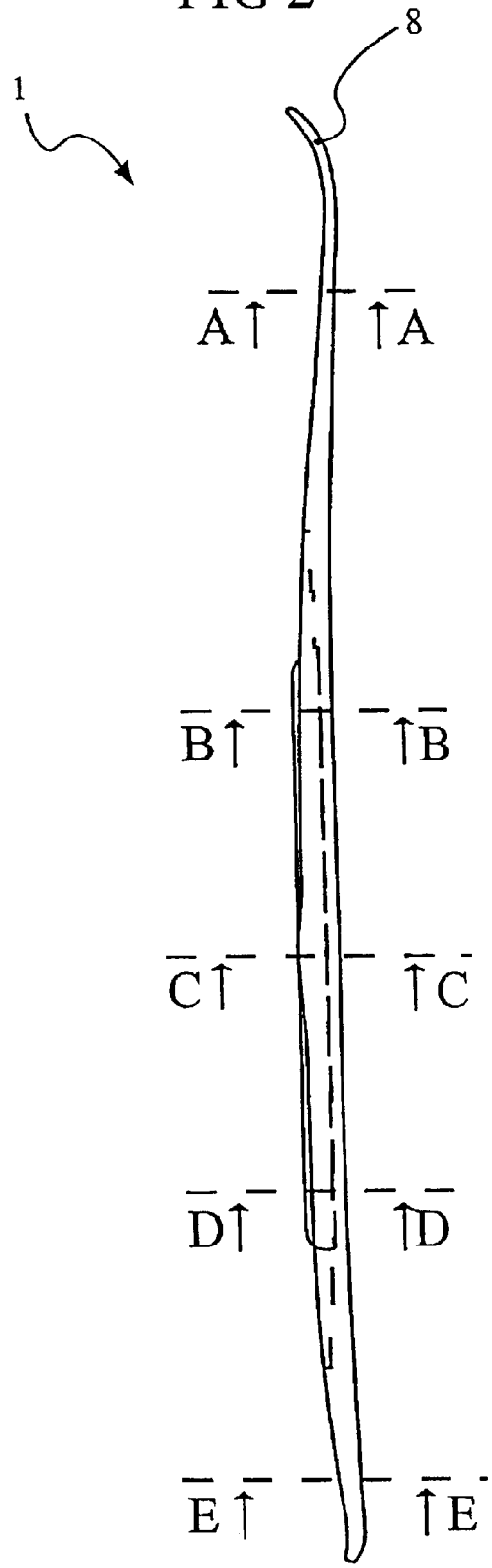

The ski bearing general reference 1 is a group of elongated shapes having a median longitudinal vertical plane P of general symmetry whose front is raised in order to form the spatula 8.

The ski 1 is formed by a principal part which we are going to call body or support base 2 on the upper surface of which is fixed, at least in a foot-plate zone 4, a complementary element 3 intended to receive the retention binding of the boot of the user.

The support base 2 is the element which is in contact with the snow and has the shape of an elongated beam, presenting on its lower surface a sliding sole 6 bordered laterally by lateral edges 7*a*, 7*b* made of metal.

The support base 2 is an elongated beam whose front extremity is raised in order to form a spatula 8 of the ski. Said support base 2 has its own thickness, slope line, width and stiffness distribution and can be on any type and any form.

Consequently, the elongated beam forming the support base 2 can be of any known design type such as for example, sandwich type, box type, mixed mode and formed by a group of elements and components known on their own.

Figures 3, 4:
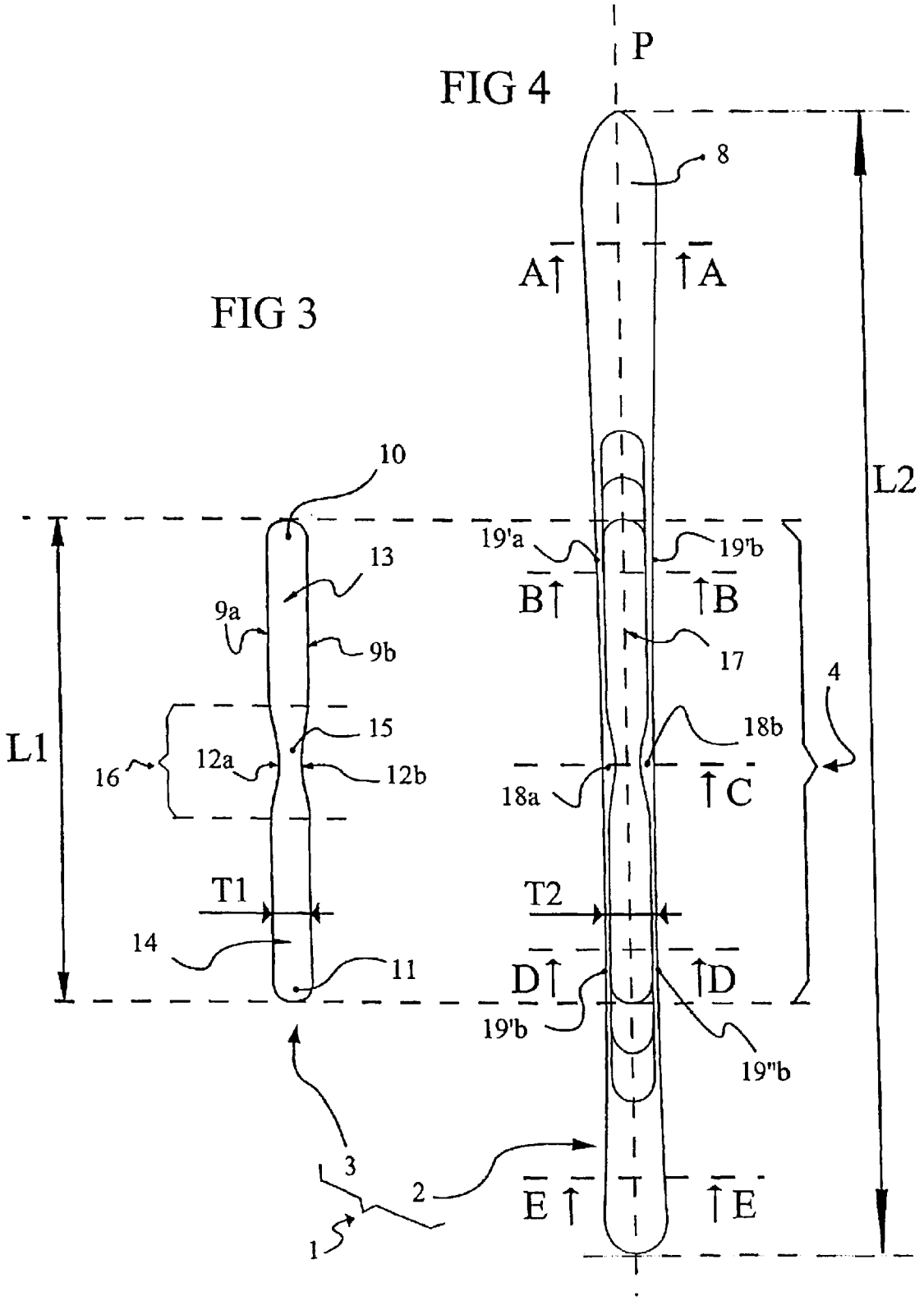
Figure 5:
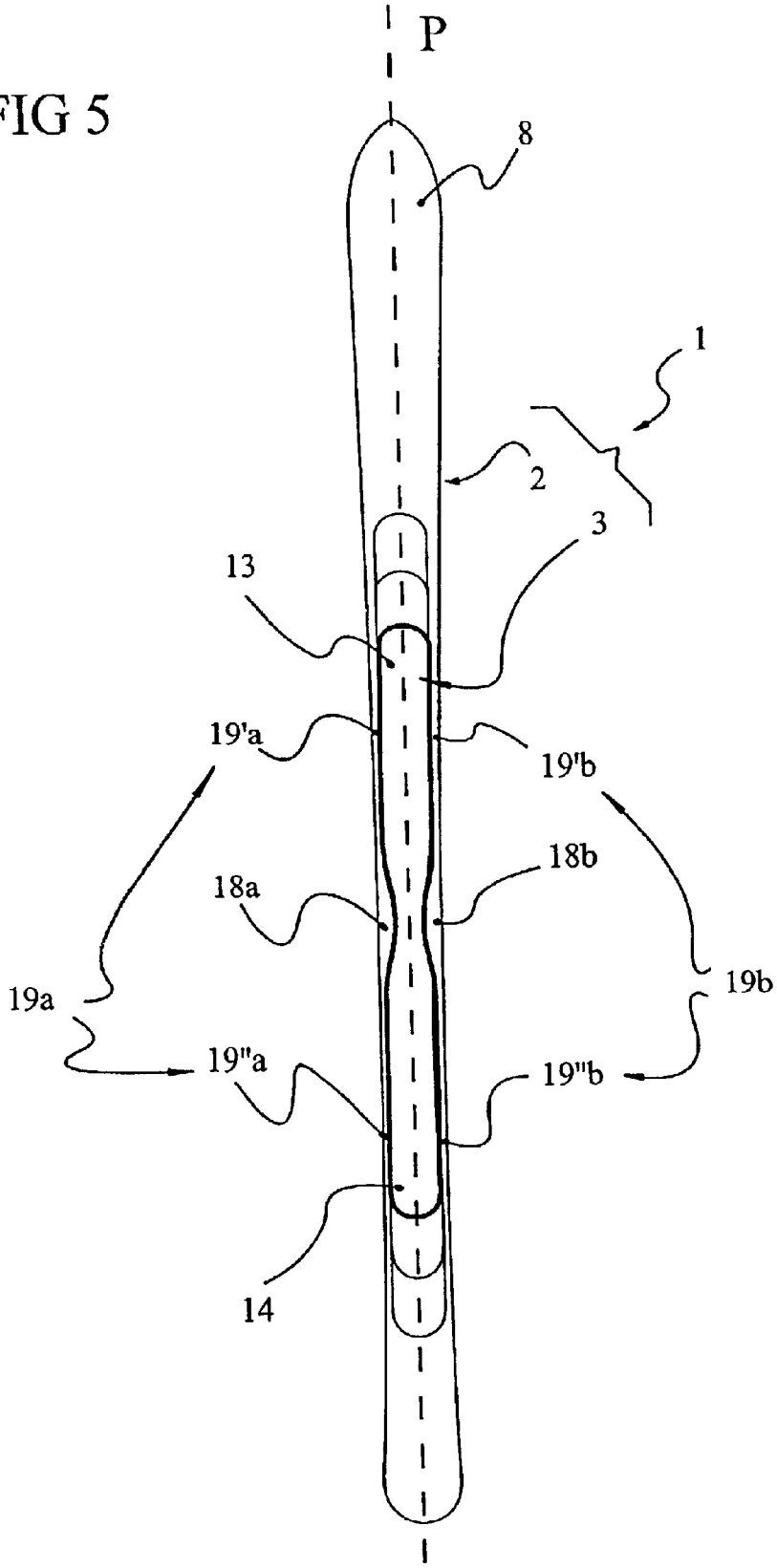
Figure 6A:
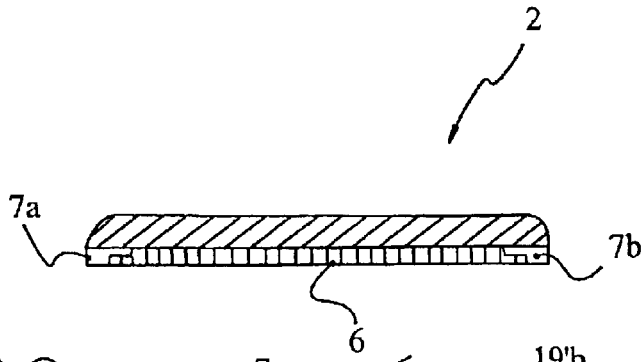
FIGS. 6*a*, 6*b*, 6*c*, 6*d*, 6*e* are transverse sectional views of the support base only, according to sections A—A, B—B, C—C, D—D, E—E of FIG. 4, in larger scale.
Figure 6B:
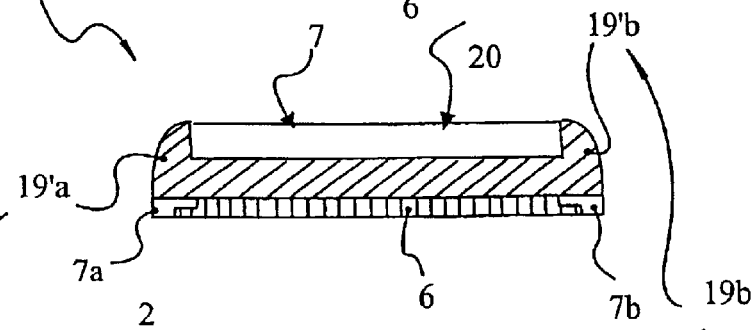
Figure 6C:
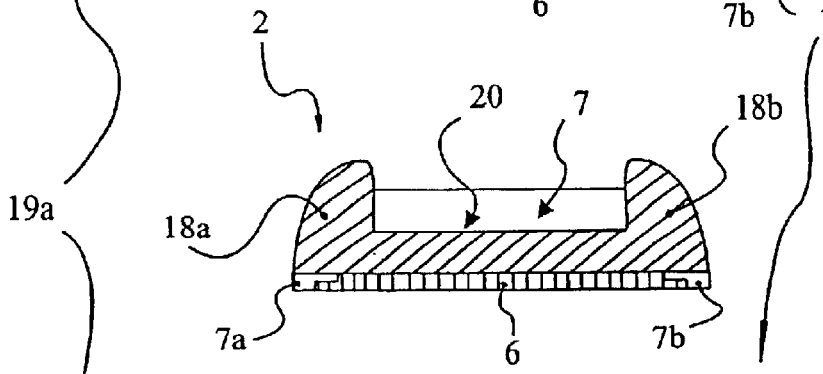
Figure 6D:
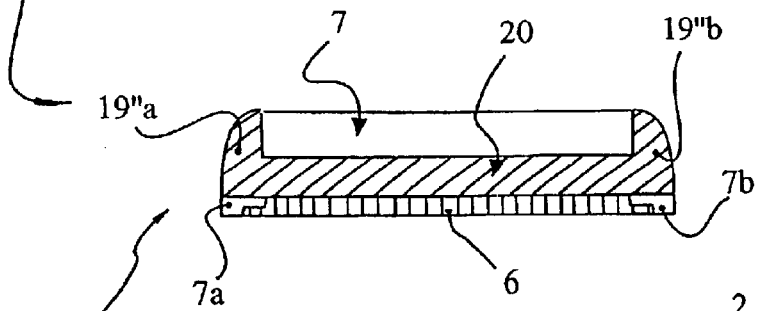
Figure 6E:
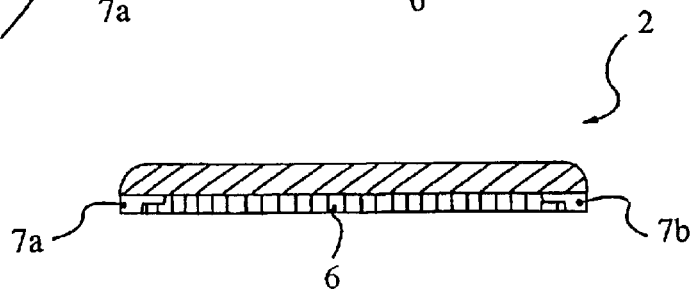
Figure 7A:
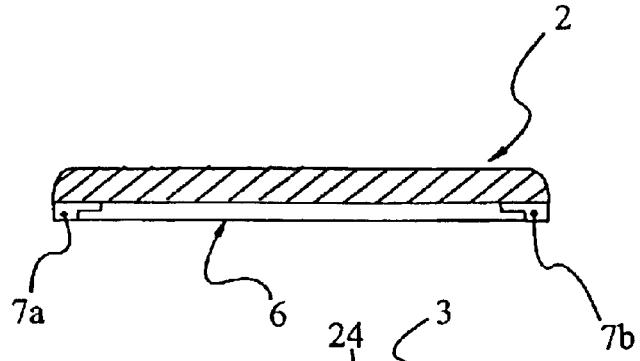
FIGS. 7*a*, 7*b*, 7*c*, 7*d*, 7*e* are sectional views according to A—A, B—B, C—C, D—D, E—E, in larger scale of the ski, i.e. of the support base equipped with its complementary element.
Figure 7B:
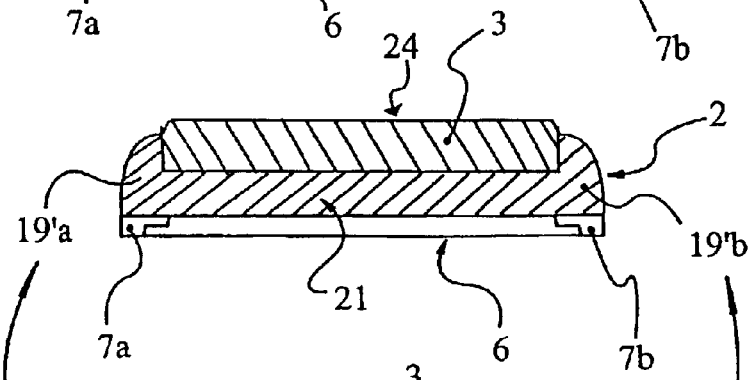
Figure 7C:
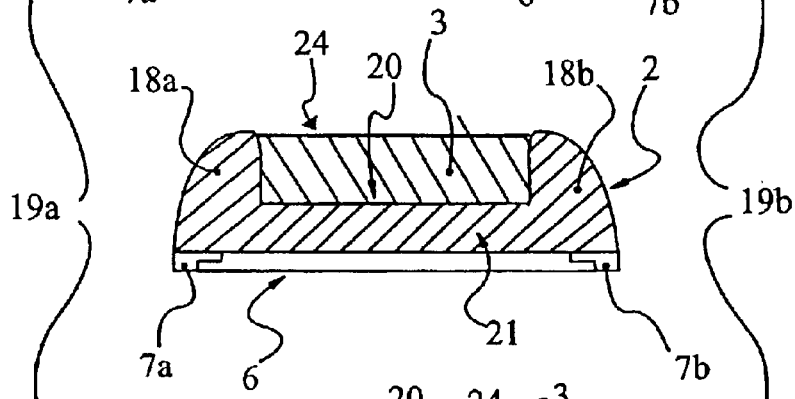
Figure 7D:
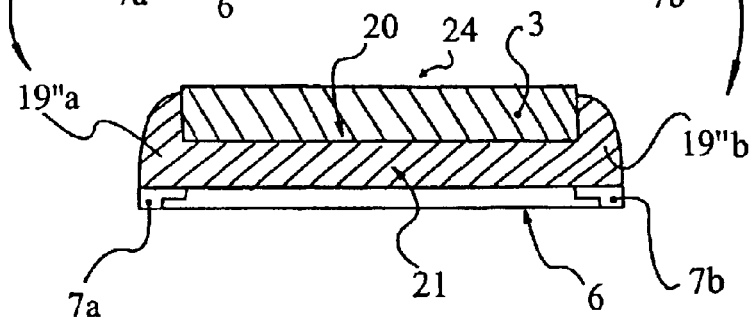
Figure 7E:
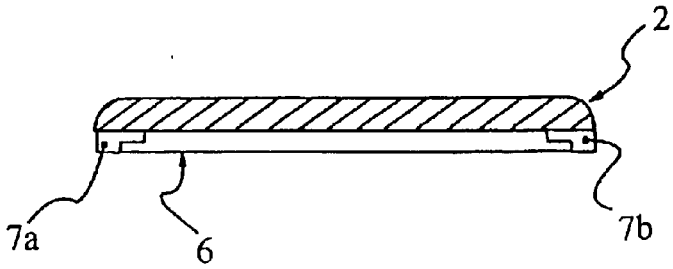
Figure 8:
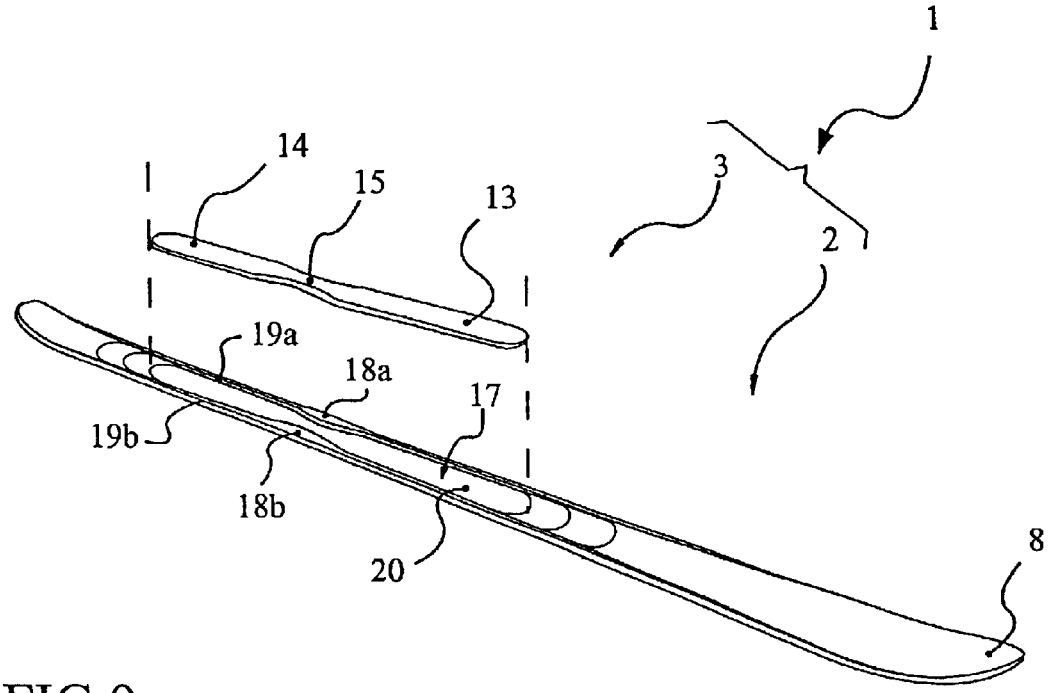
Figure 9:
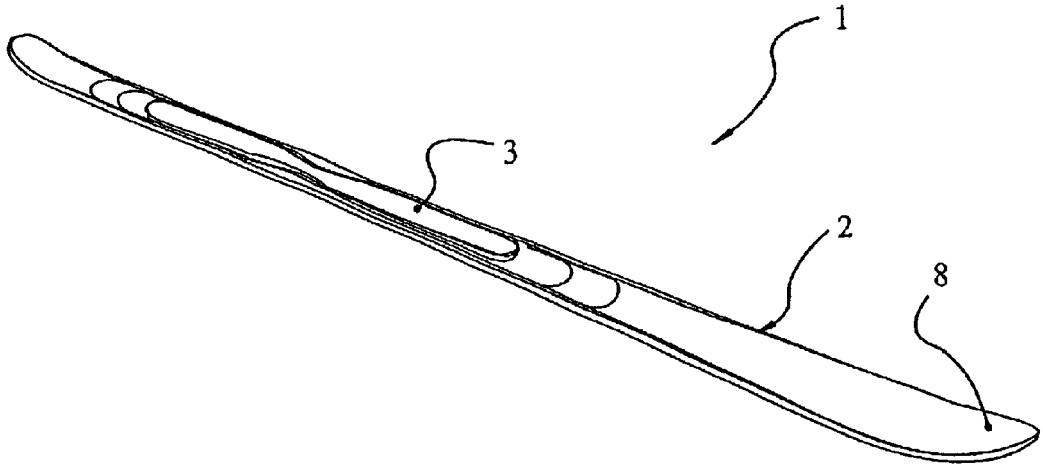

With particular reference to FIG. 3, the complementary element 3 in the form of an elongated plate, comprises two lateral edges 9*a*, 9*b* which extend between a front extremity 10 and a rear extremity 11.

The width T1 of the complementary element 3, i.e., the width T1 measured between its lateral edges 9*a*, 9*b* is smaller than the width T2 of the support base 2 at the location of measurement. According to a characteristic of the invention, the complementary element 3 is designed so that at least one of its lateral edges 9*a* and/or 9*b* comprises a hollow profile 12*a* and/or 12*b*, in such fashion that said complementary element 3 includes a front portion 13 connected to a rear portion 14 by means of a smaller size or narrow 15 zone. It should be noted that the length L1 of the complementary element 3 is smaller than the length L2 of the support base 2. By way of example, one noes that the length L1 of the complementary element 3 can comprise between 30% and 60% of the length L2 of the support base 2. Consequently, the length L1 of the complementary element can, for example, have a length ranging between 50 and 100 centimeters.

According to the preferred embodiment of the invention, the smaller sized zone 15 is located approximately in a central zone 16 of the complementary element 3 and each of the lateral edges 9*a*, 9*b* comprises a hollow profile 12*a*, 12*b*. Thus, the left lateral edge 9*a* comprises a left hollow profile 12*a*; whereas, the right lateral edge 9*b* comprises a right hollow profile 12*b*.

As is the case with respect to the support base 2, the complementary element 3 has its own configuration and structure. It has its own distribution in regarding to thickness, size and stiffness and can be of any construction type. Consequently, said complementary element 3 can be a single block element realized out of one single material. However, it can also be designed in any other fashion, such as for example, so that the front portion 13 is of a different material and/or conception than the rear portion 14.

The support base 2 is such that the upper surface comprises a housing or pocket 17 realized it the support base intended to assure retention, specifically lateral retention, of the complementary element 3 in said support base 2.

According to a characteristic of the invention, the lateral retention of the complementary element 3 is realized by at least one lateral internal projection 18*a*, 18*b* protruding towards the median plane P and intended to cooperate with the corresponding hollow profile 12*a*, 12*b* of the complementary element 3.

In the preferred design mode of the invention, the housing 17 realized in the support base 2 is an embedded housing, limited in lateral direction by two lateral edges for lateral retention 19*a*, 19*b* protruding relative to the bottom surface of the housing 20 and whose central zone comprises for each of the edges an internal lateral projection 18*a*, 18*b*.

Thus, the support base 2 comprises a right edge 19*b* including a right projection 18*b* and a left edge 19*a* including a left projection 18*a*.

It is understood that according to the preferred mode of the invention, the right projection 18*b* is prolonged toward the front by a right front edge 19'*b* and toward the rear by a right rear edge 19'*b*, while the left projection 18*a* is prolonged toward the front by a left edge 19'*a* and toward the rear by a left rear edge 19'*a*.

Precisely, according to the preferred mode, the hollow profiles 12*a*, 12*b* have a round profile, while the corresponding projections 18*a*, 18*b* have a complementary round shape. Thus, each of the projections forms a retention projection assuring lateral and longitudinal retention of the complementary element 3 in relation to the support base 2.

Figure 10:
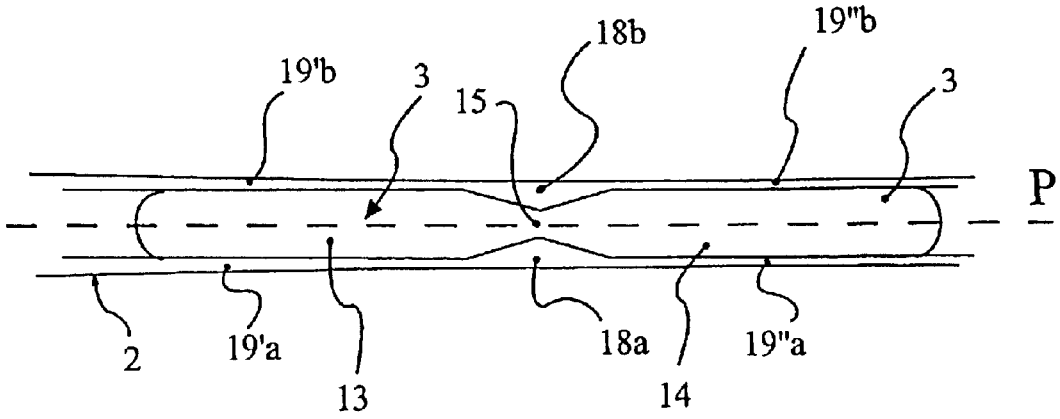
FIGS. 10, 11 and 12 illustrate various embodiments in partial views from above.
Figure 11:
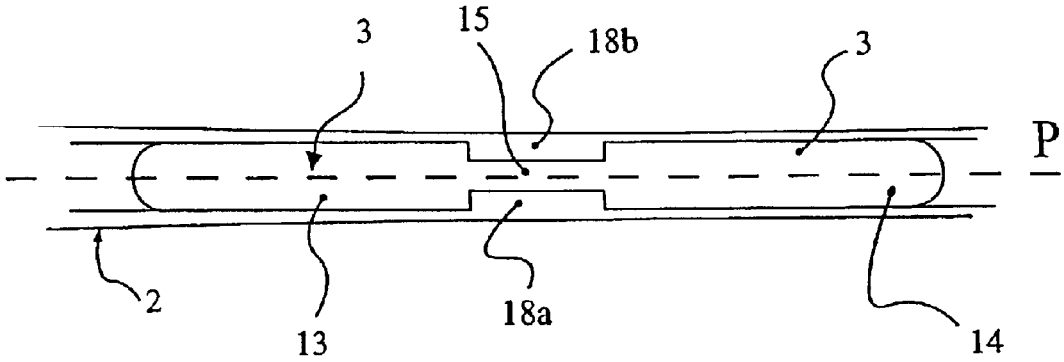

It is understood, of course, that the hollow profile or profiles 12*a*, 12*b* as well as the projecting profile or profiles 18*a*, 18*b* can have other shapes as is illustrated in FIGS. 10 and 11, —namely triangular, rectangular, even square.

Figure 12:
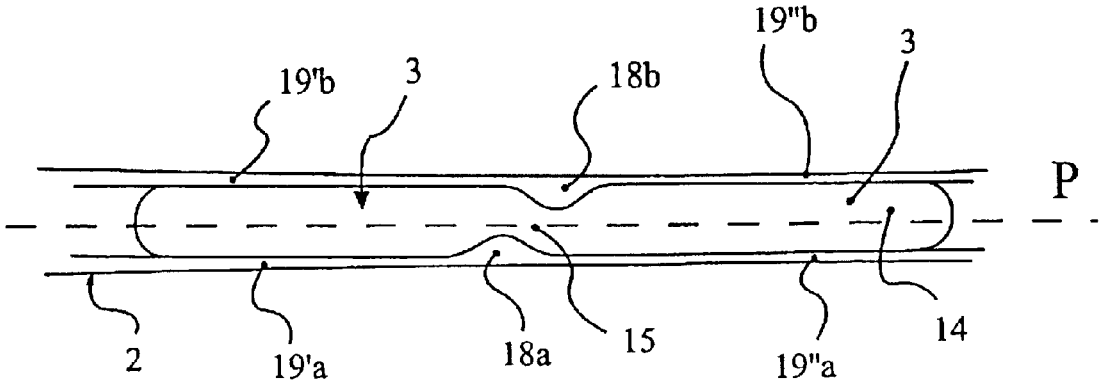

In addition, the left retention projection 18*a* with its left front edge 19'*a* and its left rear edge 19"*a* is symmetrical relative to plane P of the right projection 18'*b* with its right front edge 19'*b*, its rear edge 19"*b*. The arrangement, however, may also be different, such as for example as represented in FIG. 12, where the two lateral projections 18*a*, 18*b* are displaced longitudinally, i.e. that one of the projections, for example, is situated more to the rear than the other of the projections.

Figure 13:
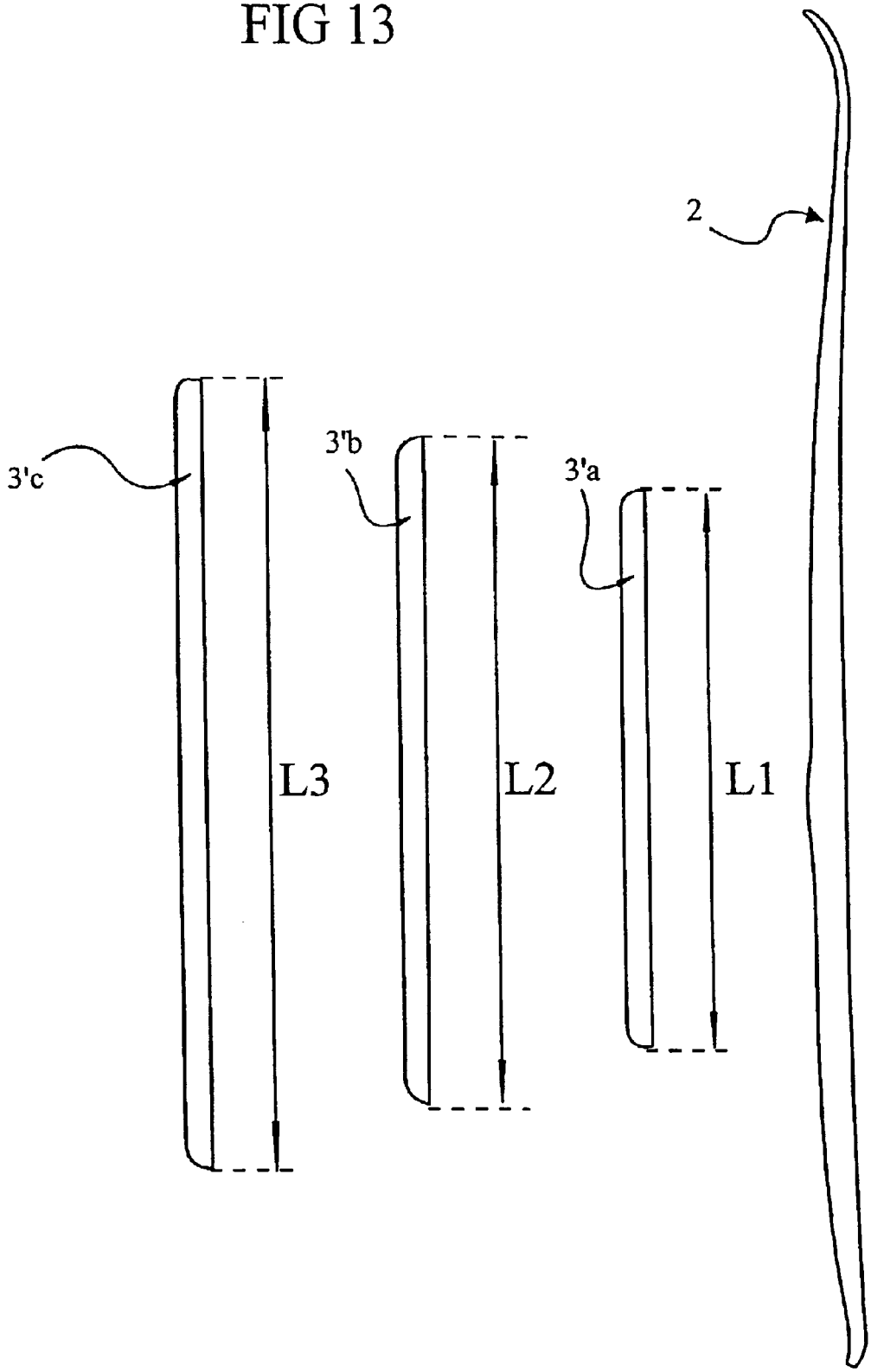
FIGS. 13, 14, and 15 are lateral views similar to FIG. 1, indicating alternate embodiments of the invention.
Figure 14:
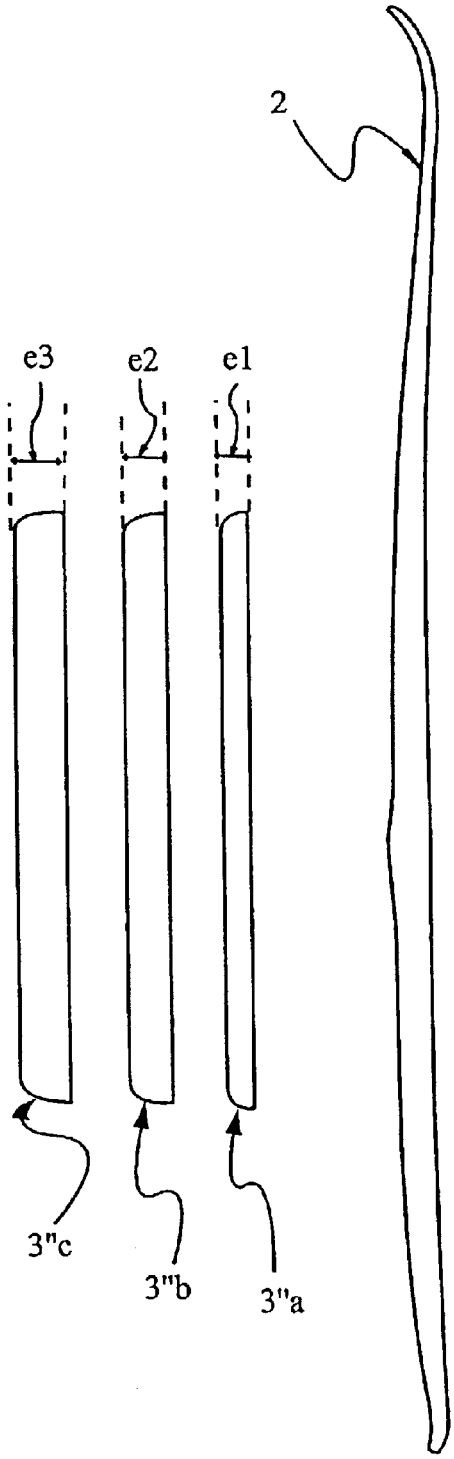
Figure 15:
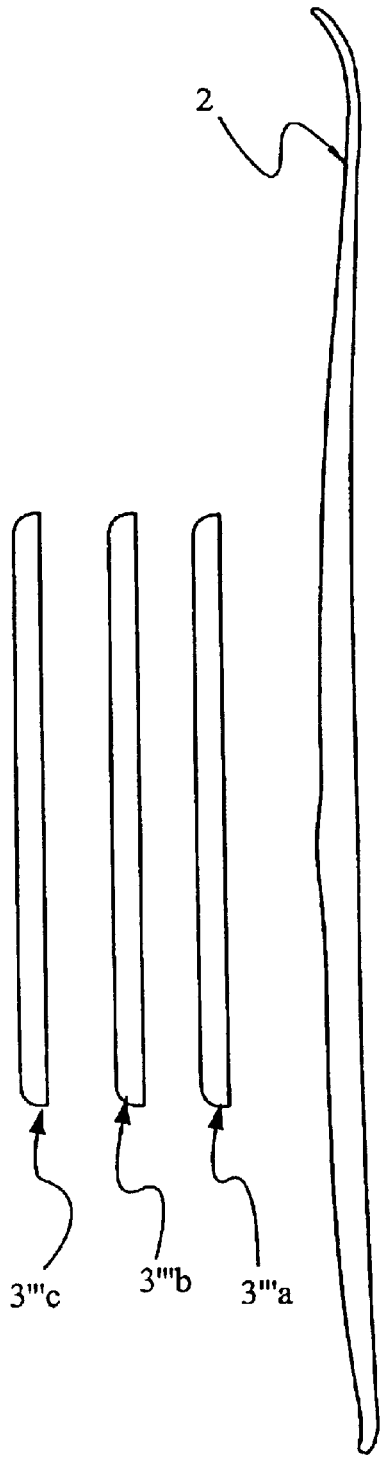

With reference to FIGS. 13–15, according to a complementary characteristic, a set of several complementary elements 3*a*, 3*b*, 3*c*–3'*a*, 3'*b*, 3'*c*–3'*a*, 3"*b*, 3"*c*–3'"*a*, 3'"*b*, 3'"*c* correspond to one support base 2.

Consequently, several complementary elements of different lengths can correspond to a given support base 2 and, for example, three complementary elements 3'*a*, 3'*b*, 3'*c* with different lengths L1, L2, L3 as is illustrated in FIG. 13. Likewise, to one given support base 2 can correspond several complementary elements 3"*a*, 3"*b*, 3"*c* with different thickness e1, e2, e3 as is illustrated in FIG. 14. It should also be noted that several complementary elements 3'"*a*, 3'"*b*, 3'"*c* with different mechanical characteristics can correspond to a given support base 2, as is illustrated in FIG. 15, intended to confer to the ski 1 formed by the support base 2 and its complementary element 3 different performance characteristics. The different characteristics can be obtained by different thickness of the complementary elements or by means of a different structure, by different materials, even by different geometry.

Fixation of the complementary element 3 on the support base 2 takes place, of course, by embedment in the corresponding housing 17, but also be connection of its lower surface 21 with a bottom surface 20 of housing 17, said connection might be realized, for example, by means of glue, or welding. Said connection can be done on the entire surface of the complementary element 3 or only on a portion of the surface, such as for example, in the zones of the front portion 13 and the rear portion 14.

Figure 16:
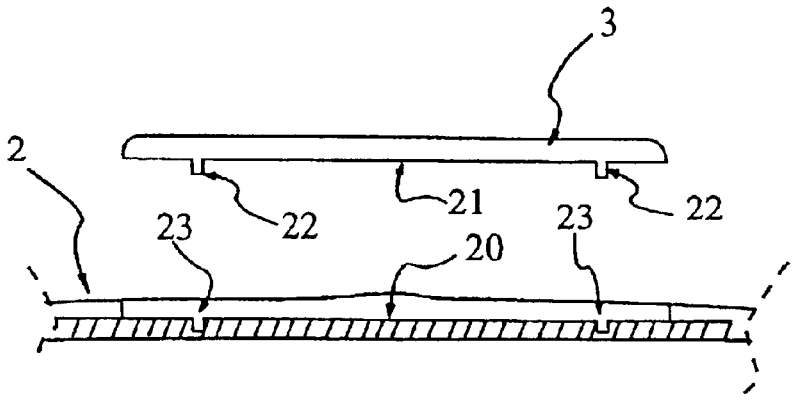
FIG. 16 is a partial lateral view in longitudinal section, indicating an embodiment variation relative to the connection between the support base and the complementary element.

Needless to say, it can also be provided that the connection of the complementary element 3 on the support base 2 is realized mechanically, such as, for example, by embedding the projection 22 in the corresponding holes 23, as illustrated in FIG. 16.

Figure 17:
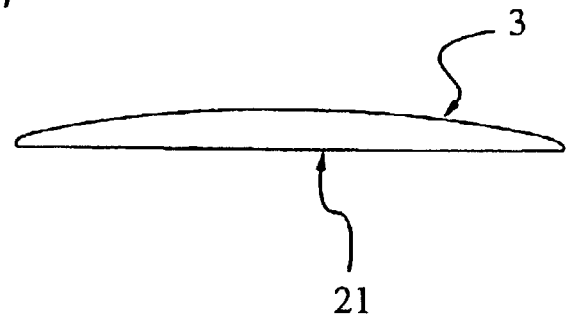
FIGS. 17 and 18 depict lateral views of two design variations of the complementary element.

One notes that the thickness 2 of the complementary element 3 can be constant, as shown in FIGS. 1 to 16, or varied, as illustrated in FIG. 17, in order to be, for example, thicker in the center of the smaller size zone 15 or thinner in the zone 16 of lesser thickness. It is understood, of course, that the thickness of the complementary element could be such that the front would be thicker than the rear, or conversely, in such manner that the upper surface 24 of the complementary element 3 is inclined relative to the surface of the sole 6 as is illustrated in FIGS. 23*a*, 23*b*, 23*c*, 23*d*, 23*e*, and 24*a*, 24*b*, 24*c*, 24*d*, 24*e*. According to the variation illustrated in FIGS. 23*a*, 23*b*, 23*c*, 23*d*, 23*e*, the thickness of the complementary element 3 progressively diminishes toward the rear; whereas, according to the variation illustrated in FIGS. 24*a*, 24*b*, 24*c*, 24*d*, 24*e*, the thickness of the complementary element 3 progressively diminishes toward the front. Thus, embedment of the complementary element 3 in the housing 17 can be either total or partial, that is to say that the upper surface 24 of the complementary element can, at least in certain locations, go beyond the lateral edges.

Figure 18:
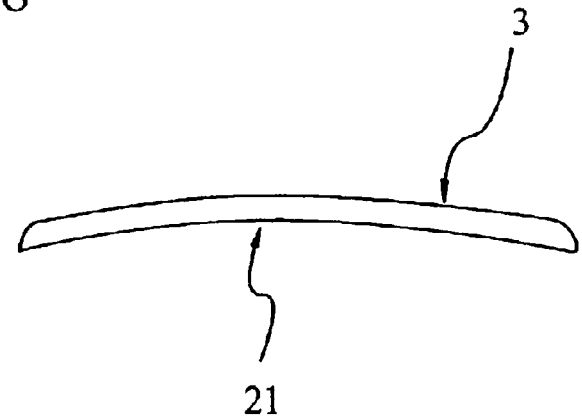
Figure 19:
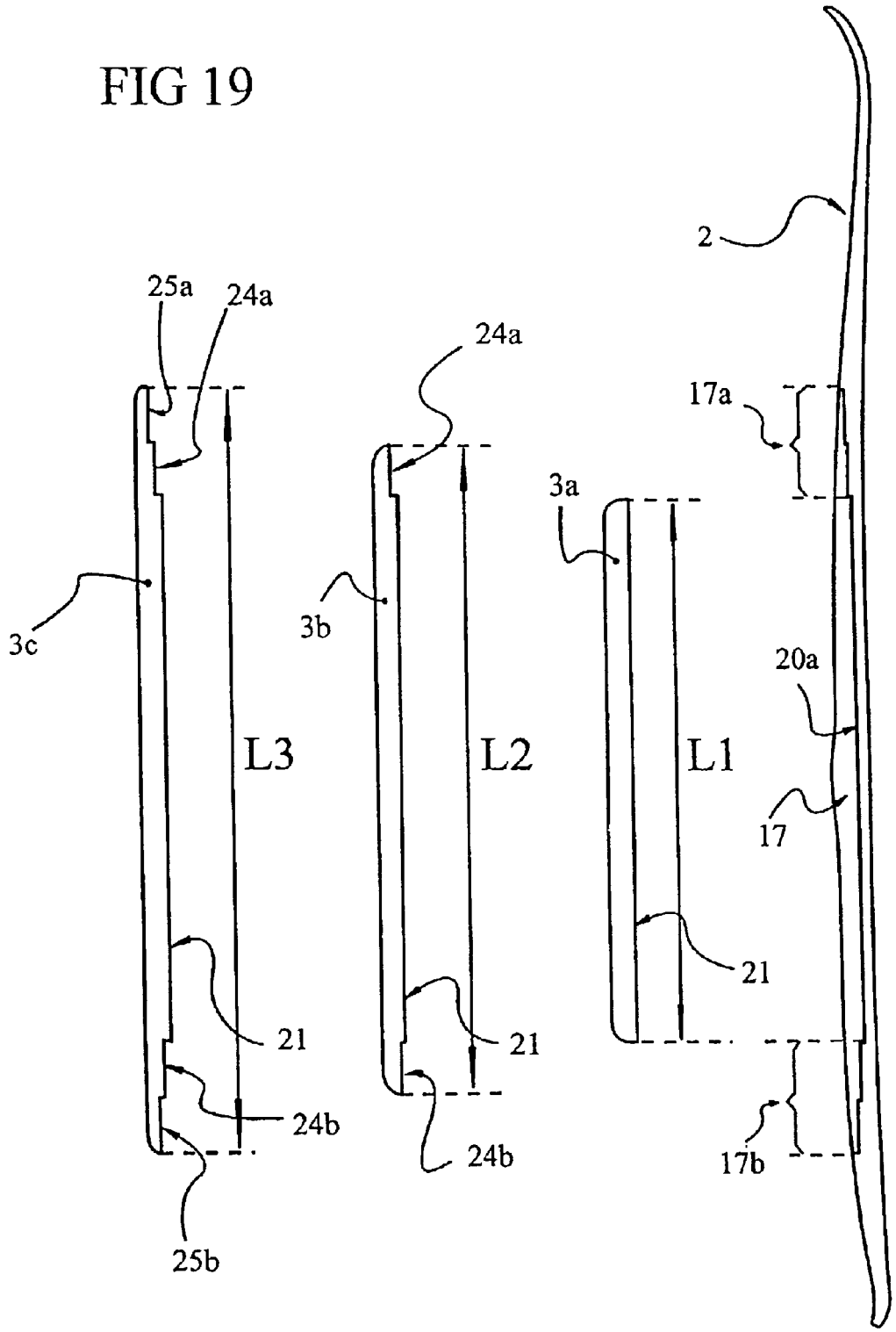
FIG. 19 illustrates a support base with three possible complementary elements.
Figure 19A:
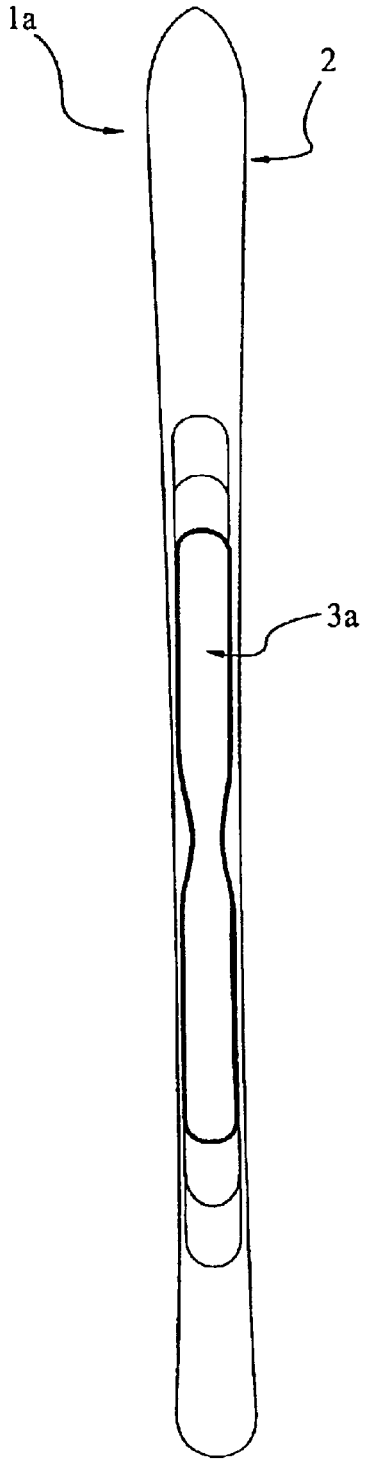
FIGS. 19*a*, 19*b*, 19*c* indicate in bird's eye view, three different skis, formed by an identical support base but equipped with either one of the complementary elements of the preceding Figure.
Figure 19B:
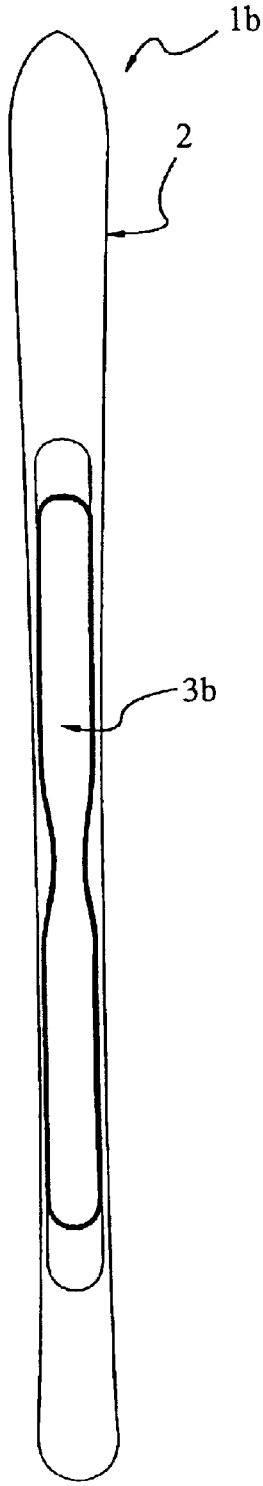
Figure 19C:
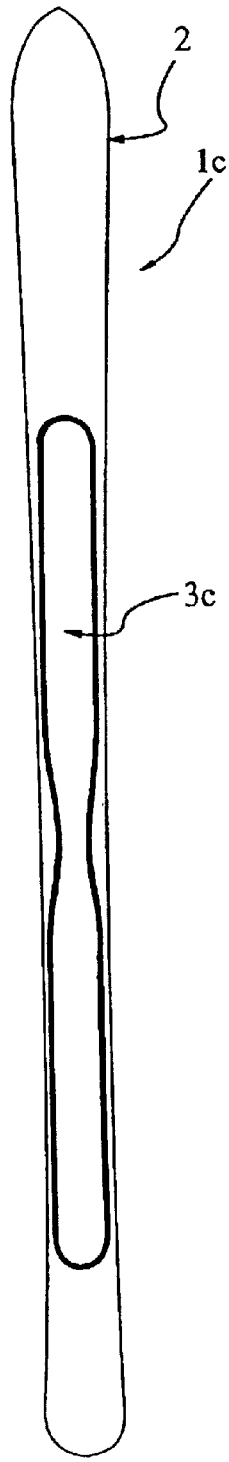

In addition, the lower surface 21 of the complementary element 3 can be level, as is illustrated in FIGS. 1 to 17, or rounded, for example, concave, as illustrated in FIG. 18, and, in such as, the surface of the bottom 20 of housing 17 has the corresponding curvature.

One has already noted previously that a set of several complementary elements can correspond to a given support base.

According to the preferred mode of the invention illustrated an FIGS. 19, 19*a*, 19*b*, 19*c*, to support base 2 correspond several complementary elements 3*a*, 3*b*, 3*c* having different lengths or different shapes, notably at the level of their front and rear extremities. Consequently, the first complementary element 3*a* that is to say the one shortest in length L1 is a plate whose lower surface 21 is flat in order to cooperate with the central portion 20*a* of the bottom 20 of the embedment housing 17 whereas the second complementary element 3*b* of intermediate length L2 comprises an extremity disengagement at the front 24*a* and at the rear 24*b*, while the extremity of the third complementary element 3*c* with the greatest length L3 comprises a first front extremity disengagement 24*a* and a second front extremity disengagement 25*a* and a first rear extremity disengagement 24*b* and a second rear disengagement 25*b*. It should be added that the housing 17 and specifically its bottom surface 20 is configured for cooperation with any one of the complementary elements 3*a*, 3*b*, 3*c*. Thus, the front extremity 17*a* and the rear extremity 17*b* comprise a zone in the shape of steps, in such manner so as to correspond to the disengagements of the extremities of the complementary element 3. The front extremity 17*a* of housing 17 as well as the rear extremity 17*b* of the housing are configured relative to shape and dimensions to receive and cooperate with the different complementary elements 3*a*, 3*b*, 3*c*. It is clear that thanks to three different complementary elements 3*a*, 3*b*, 3*c* on the base of a single support 2 it is possible to realize three different skis, the first one la represented by the support base 2 and the first complementary element 3*a*, the second one 1*b* represented by the support base 2 and the second complementary element 3*b* and the third one 1*c* represented by the support base 2 and the third complementary element 3*c*—these three different skis being respectively represented in FIGS. 19*a*, 19*b*, 19*c*.

Figure 20:
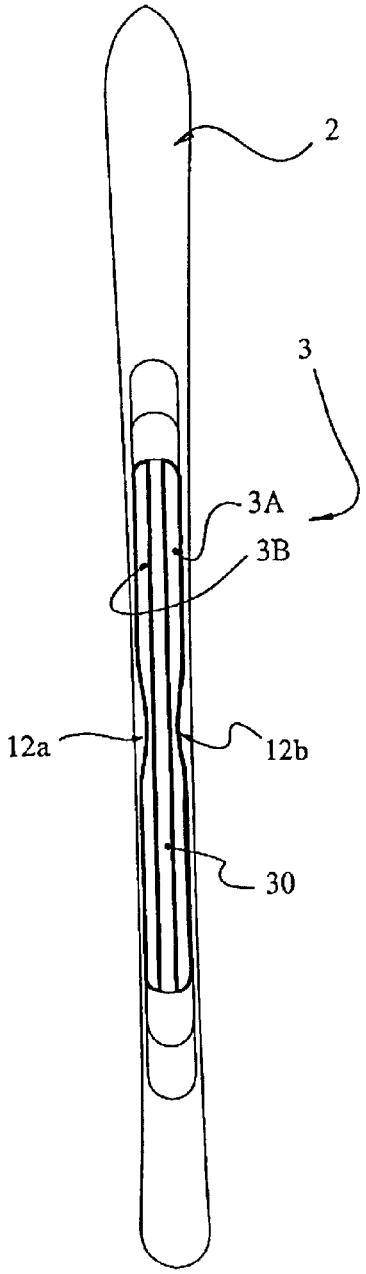
FIGS. 20 and 21 are bird's eye views, depicting two other embodiment variations.
Figure 21:
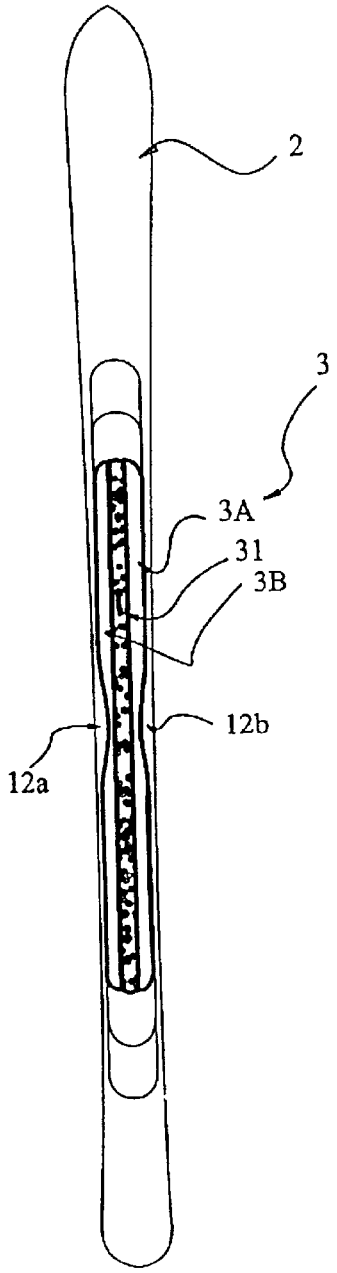

FIGS. 20 and 21 representing two other design variations, according to which the complementary element 3 is formed by two adjacent individual complementary elements 3A, 3B. It should be noted that each of these individual elements includes its own hollow profile 12*a*, 12*b* on its external lateral edge which is supported laterally on the corresponding edge 19*a*, 19*b* of the support base 2 while the internal lateral projection of the edge cooperates with the corresponding hollow profile.

According to the variation illustrated in FIG. 20, the two individual complementary elements 3A, 3B are separated by a longitudinal space 30.

According to the design variation of FIG. 21, the longitudinal space comprises an intermediate element 31 which can, for example, be a shock-absorbing element realized of elastically deformable material.

Figure 22:
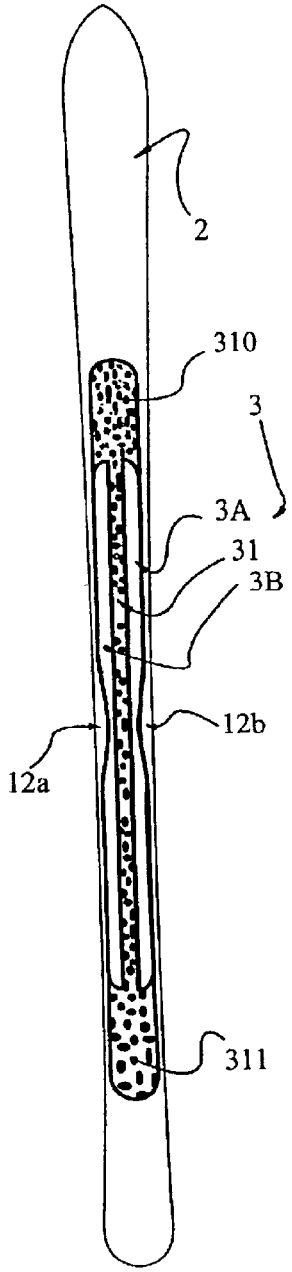
FIG. 22 depicts a design variation of the ski of FIG. 21.
Figure 23A:
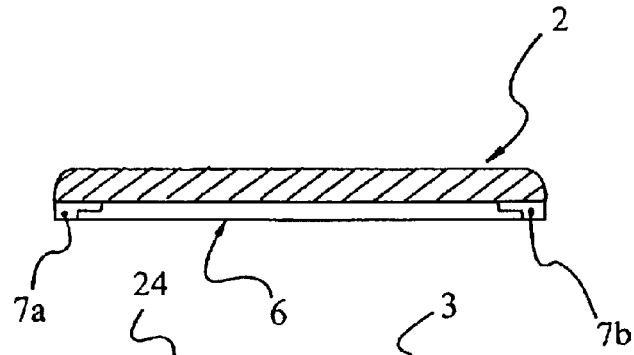
FIGS. 23*a*, 23*b*, 23*c*, 23*d*, 23*e*, and 24*a*, 24*b*, 24*c*, 24*d*, 24*e* are views similar to FIGS. 7*a*, 7*b*, 7*c*, 7*d*, 7*e*, depicting two embodiment variations.
Figure 23B:
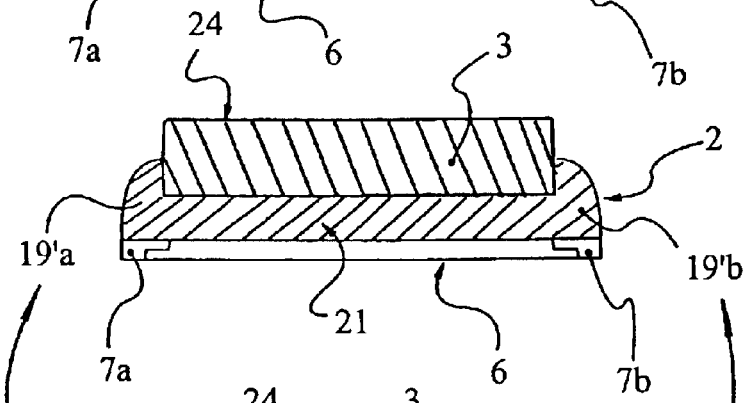
Figure 23C:
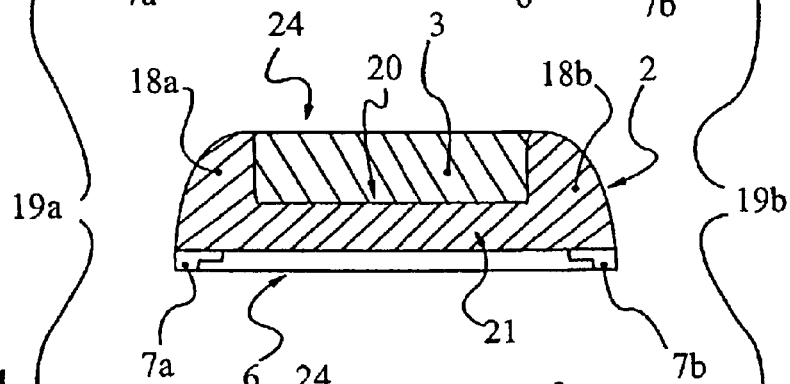
Figure 23D:
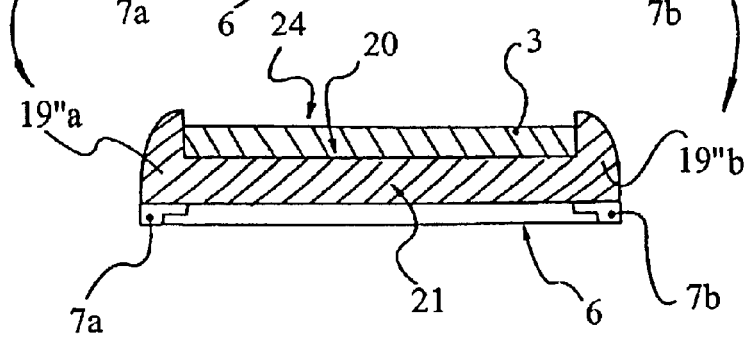
Figure 23E:
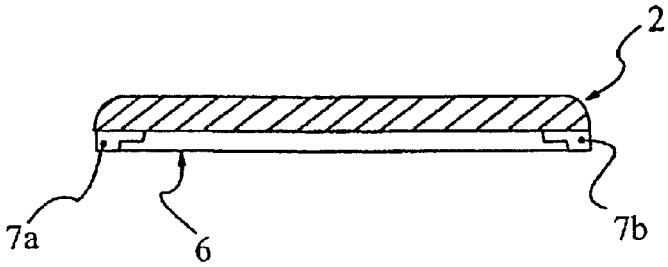
Figure 24A:
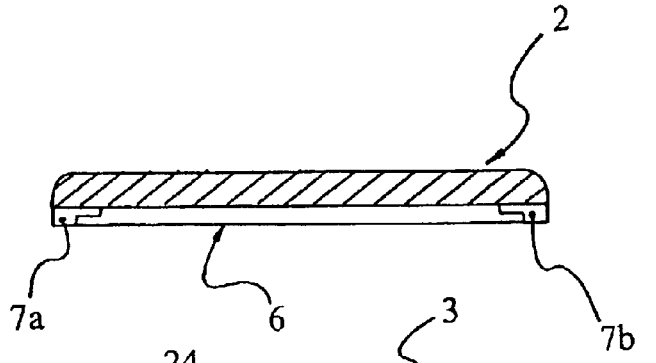
Figure 24B:
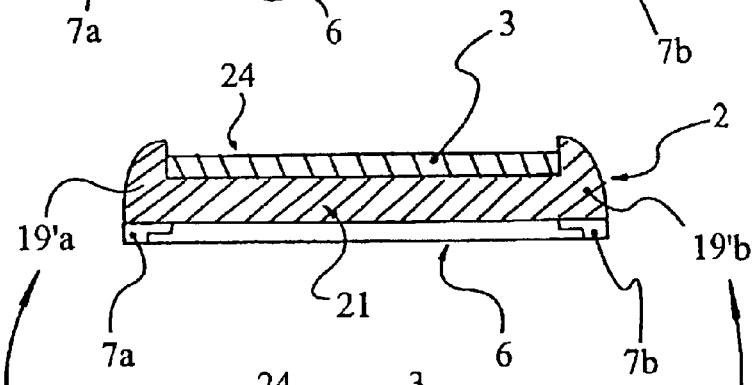
Figure 24C:
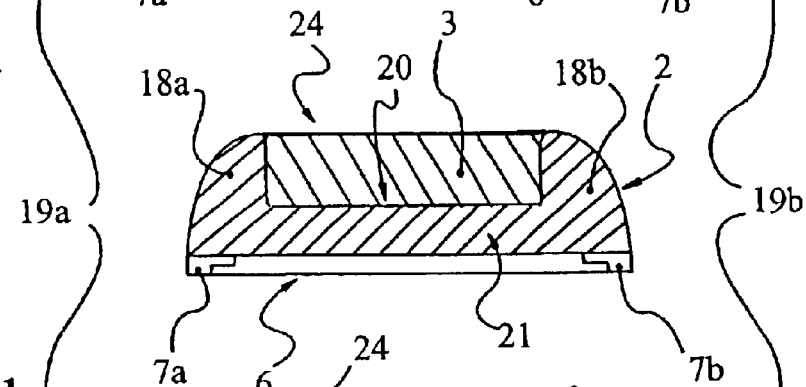
Figure 24D:
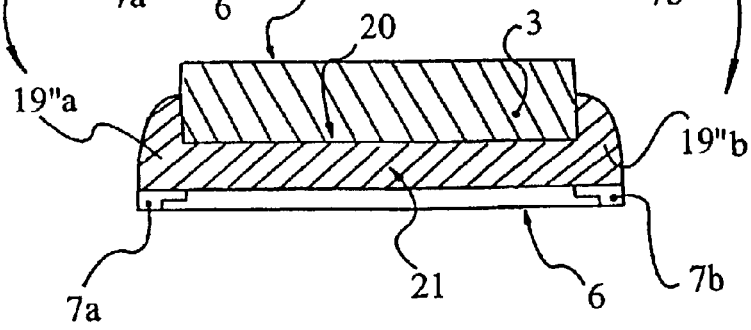
Figure 24E:
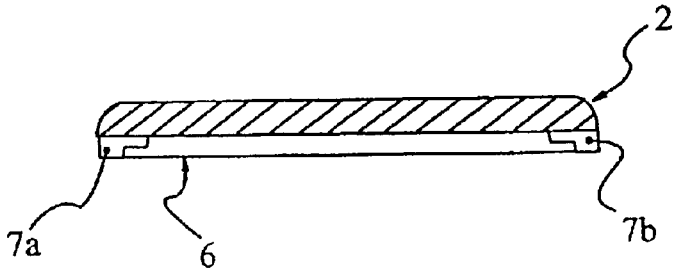

FIG. 22 depicts a design variation of the ski of FIG. 21, according to which the intermediate shock-absorbing element 31 extends toward the front and toward the rear beyond the extremities of the individual complementary elements 3A, 33 in order to form enlarged front 310 and rear 311 end zones, being placed in the front 17*a* and rear 17*b* extremities of housing 17.

Figure 25:
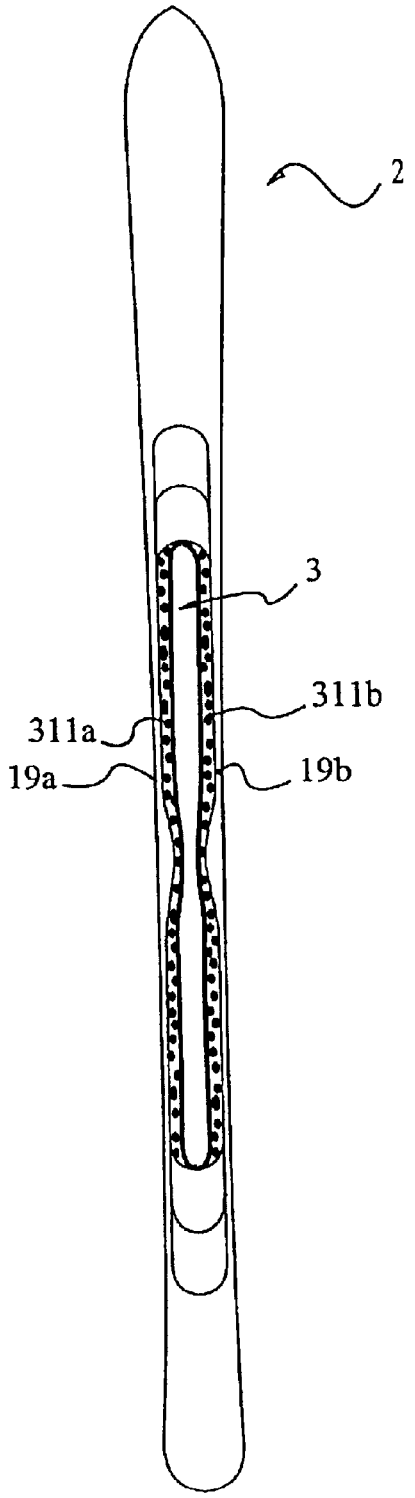
FIGS. 25 and 26 are bird's eye views of two other embodiment variations.

FIGS. 25 and 25 are bird's eye views of two other embodiment variations. According to these two variations, the intermediate element possesses shock-absorbing properties and is arranged between the complementary element 3 and the lateral retention edges 19*a*, 19*b*.

According to the design mode illustrated in FIG. 25, a left lateral element 311*a* having shock-absorbing properties has been arranged between the two lateral retention edges 19*a*, 19*b* and a right lateral element 311*b* which shock-absorbing properties extending over the full length of the complementary element 3. It is understood, of course, that one does not go outside the scope of the invention if the lateral shock-absorbing element were provided on only one side or would not extend over the entire length of the complementary element 3 but only over a portion of its length. It is clear that the lateral element with shock-absorbing properties 311*a*, 311*b* in this design mode was arranged "sandwich-like" between the lateral border or borders 9*a*, 9*b* of the complementary element 3 and the lateral retention edge or edges 19*a*, 19*b*.

Figure 26:
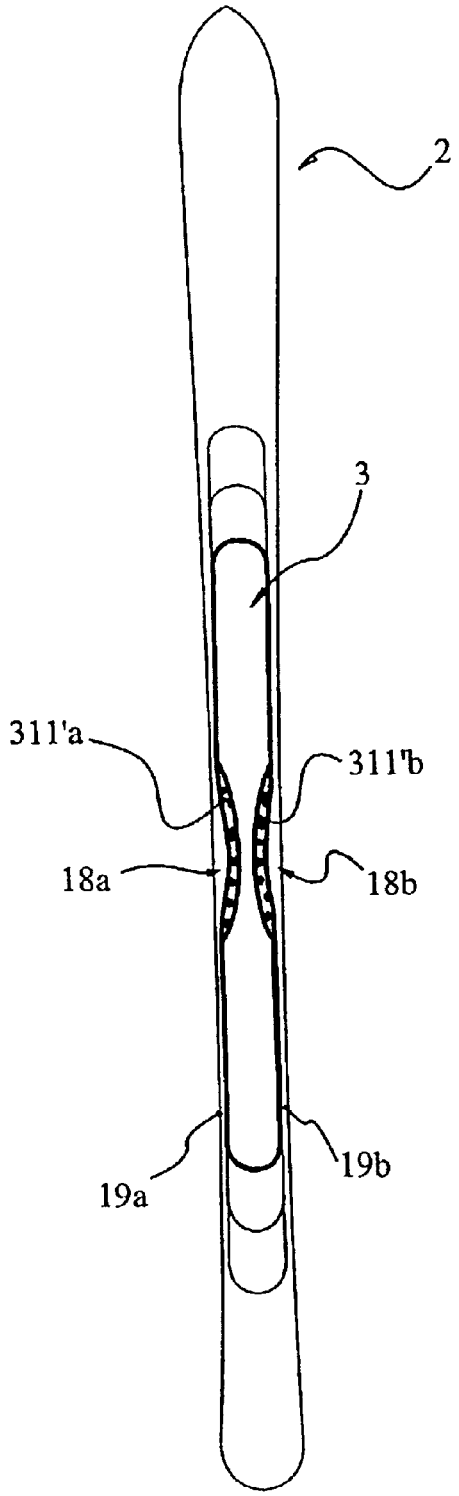

Thus, according to the design mode represented in FIG. 26, the lateral element having shock-absorbing properties 311'*a*, 311'*b* extends only up to the level of the lateral internal projection 18*a*, 18*b*. In said variation, one does not go outside the frame-work of the invention if the lateral element having shock-absorbing properties were provided on only one side. It is clear that the lateral element having shock-absorbing properties 311'*a*, 311'*b* was arranged in "sandwich-like" fashion in this mode of embodiment between the internal lateral projection or projections 18*a*, 18*b* of the support base 2 and the hollow profile or profiles 12*a*, 12*b* of the complementary element 3.

The lateral element or elements having shockabsorbing properties 311*a*, 311*b*–311'*a*, 311'*b* of design modes according to FIGS. 25 and 26, is/are made of elastically deformable material, such as, for example, a visco-elastic material, and, for example of caoutchouc, of rubber-elastomer, or visco-elastic caoutchouc, or of any other equivalent material.

It should be added that the external flanks of the lateral edges 19*a*, 19*b* are of beneficial round shape.

It is understood, of course, that the invention is not limited to the embodiment modes described and represented by way of example, but includes also all equivalent techniques as well as combinations of same.

Having thus described the preferred embodiment, the invention is now claimed to be:

1. A skiing construction with a vertical median plane of general symmetry, comprising:

a principal support base on an upper surface of which is fixed at least in a foot-plate zone a complementary longitudinal element for receiving a retention binding for a boot of a user, said support base having the shape of an elongated beam with a sliding sole whose front extremity is raised to form a tip, the complementary longitudinal element having the shape of an elongated plate whose width measured between its lateral borders is smaller than a width of the support base the complementary element including a front portion connected to a rear portion by a zone of smaller width which defines a hollow profile and the complementary element being embedded in a pocket defined in the support base, the housing support base including an internal lateral projection extending laterally into the pocket to cooperate with the hollow profile of the complementary element to retain the complementary element both longitudinally and laterally.

2. The skiing construction according to claim 1 wherein a length of the complementary element ranges between 30% and 60% of a length of the support base.

3. The skiing construction according to claim 1 wherein the common support base corresponds to several complementary elements a first complementary elements which is shortest in length being a plate whose lower surface cooperates with a central portion the housing while a second complementary element of intermediate length has a disengagement of the extremity in its front and rear, a third complementary element having the greatest length including a first disengagement of the extremity in its front and a second disengagement of the front extremity and a first disengagement of its rear extremity and a second rear disengagement, and in that a bottom surface of the housing is configured to cooperate with any of the complementary elements, the front extremity and the rear extremity including a stepped-up shaped zone in such manner so as to correspond to the disengagements of the extremities of the complementary element.

4. The skiing construction according to claim 1 wherein a thickness of the complementary element is thicker at one of its front and rear relative to the other, an upper surface of the complementary element being inclined relative to a surface of the sole.

5. The skiing construction according to claim 1 further including an intermediate element with shock-absorbing properties arranged between the complementary element and the lateral retention edge or edges.

6. The skiing construction according to claim 1 wherein the complementary element is formed by two individual adjacent complementary elements.

7. The skiing construction according to claim 6 wherein the two complementary individual adjacent elements are separated by a longitudinal space, which includes an intermediate element made of elastically deformable material having shock-absorbing properties.

8. A skiing construction with a vertical median plane of generally symmetry, comprising:

a principal support base on an upper surface of which a foot-plate zone is defined for receiving a retention binding for a boot of a user, said support base having the shape of an elongated beam with a sliding sole and a front extremity raised to form a tip;

a recessed pocket defined in the support base upper surface and limited laterally by two lateral retention edges of the support base extending between a bottom surface of the pocket and the support base upper surface and whose a central zone of the pocket being narrowed by internal lateral projections of the support base protruding and extending laterally into the pocket toward the median plane of symmetry;

a complementary longitudinal element having the shape of an elongated plate whose width measured between its lateral borders is smaller than a width of the support base and at least one of its lateral borders includes a hollow profile that defines a zone of smaller width, the complementary element including a front portion connected to a rear portion by the zone of smaller width, the complementary element being embedded in the pocket recessed in the support base with the internal lateral projections cooperating with the hollow profile of the complementary element.

9. The skiing construction according to claim 8 wherein the zone of lesser width of the complementary element is located adjacent a central zone of the complementary element and each of the lateral borders includes a hollow profile, a left of the lateral borders includes a left hollow profile, while a right of the lateral borders includes a right hollow profile.

10. The skiing construction according to claim 9 wherein the hollow profiles have a rounded profile, while the corresponding internal lateral projections have a complementary round shape, so that each of the projections represents a retention projection assuring lateral and longitudinal retention of the complementary element relative to the support base.

11. The skiing construction according to claim 8 wherein the complementary element is formed by two individual and independent adjacent complementary elements each of the individual elements having its own hollow profile on its external lateral border, the complementary elements both being received in the pocket of the support base with the internal lateral projections engaging the hollow profiles of both complementary elements.

12. The skiing construction according to claim 11 further including a shock-absorbing element of elastically deformable material received in the pocket.

13. The skiing construction according to claim 12 wherein the shock-absorbing element is disposed between the two individual complementary elements.

14. A skiing construction comprising:

a principal support base on an upper surface of which a complementary element receiving pocket is defined at least in a foot-plate zone for receiving a retention binding for a boot of a user, said support base having the shape of an elongated beam with a sliding sole whose front extremity is raised to form a tip, the support base including an internal lateral projection which extends laterally into a central portion of the pocket to define a lateral retention edge;

a set of several different complementary elements corresponding to the support base, each complementary longitudinal element having the shape of an elongated plate whose width measured between its lateral borders is smaller than a width of the support base and dimensioned for receipt in the pocket, each complementary element including a front portion connected to a rear portion by a hollow profile of smaller width which engages and is retained by the lateral retention edge when each complementary element is removably disposed in the pocket.

15. The skiing construction according to claim 14 wherein the several complementary elements are of different lengths.

16. The skiing construction according to claim 14 wherein the several complementary elements are of different thickness.

17. The skiing construction according to claim 14 wherein the several complementary elements have different mechanical characteristics to confer to the support base different performance characteristics.

18. The skiing construction according to claim 14 wherein the several complementary elements have different lengths and different shapes at their front and rear extremities.

19. A skiing construction with a vertical median plane of generally symmetry, comprising:

a principal support base on an upper surface of which is fixed at least in a foot-plate zone a complementary longitudinal element for receiving a retention binding for a boot of a user, said support base having the shape of an elongated beam with a sliding sole whose front extremity is raised to form a tip, the complementary longitudinal element having the shape of an elongated plate whose width measured between its lateral borders is smaller than a width of the support base and at least one of its lateral borders includes a hollow profile, the complementary element including a front portion connected to a rear portion by a zone of smaller width and the complementary element being embedded in a housing defined in the support base, the housing including at least one lateral retention edge with an internal lateral projection which cooperates with the hollow profile of the complementary element, the common support base corresponds to several complementary elements of which at least one includes at least one extremity disengagement in a front or in a rear and in that a bottom surface of the housing is configured to cooperate with any one of the complementary elements, whose front extremity or rear extremity includes at least one stepped-up zone, in such fashion so as to correspond to the disengagement of the extremity or the extremities of the complementary element.

20. A ski construction with adjustable physical properties, the ski construction comprising:

a principal ski base having a lower sliding surface and an opposite upper face which is adapted to receive a binding;

an elongated pocket defined centrally in the upper face, the pocket being laterally narrowed by a laterally projecting portion of the ski base which defines a lateral retention edge;

a plurality of longitudinal elements which are configured to be individually received and mounted in the pocket, each of the longitudinal elements having a narrowed region that defines a hollow profile for engaging the lateral retention edge, the longitudinal elements differing in at least one of:

(a) length;

(b) stiffness;

(c) thickness;

(d) construction;

(e) material properties;

such that changing a one of the longitudinal elements that is received in the pocket changes skiing characteristics of the principal ski base.

* * * * *